US006294587B1

(12) United States Patent
Wittenbrink et al.

(10) Patent No.: US 6,294,587 B1
(45) Date of Patent: Sep. 25, 2001

(54) WATER EMULSIONS OF FISCHER-TROPSCH LIQUIDS (LAW516)

(75) Inventors: Robert J. Wittenbrink, Baton Rouge, LA (US); Paul J. Berlowitz, East Windsor, NJ (US); Tapan Chakrabaty, Calgary (CA); Loren L. Ansell; Daniel F. Ryan, both of Baton Rouge, LA (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/240,785

(22) Filed: Jan. 25, 1999

Related U.S. Application Data

(63) Continuation of application No. 08/928,236, filed on Sep. 12, 1997, now abandoned.

(51) Int. Cl.[7] ..... B01F 3/08; B01F 17/42; C10L 1/32

(52) U.S. Cl. ..... 516/76; 44/301; 44/302; 137/13

(58) Field of Search ..... 516/76; 44/301, 44/302; 208/950; 137/13

(56) References Cited

U.S. PATENT DOCUMENTS

| | | | | |
|---|---|---|---|---|
| 2,920,948 | * | 1/1960 | Weeks | 44/301 |
| 3,425,429 | * | 2/1969 | Kane | 137/13 |
| 3,641,181 | * | 2/1972 | Robbins et al. . | |
| 3,985,932 | * | 10/1976 | Porter | 106/271 X |
| 4,568,480 | * | 2/1986 | Thir et al. | 516/76 X |
| 4,832,819 | | 5/1989 | Hamner | 208/27 |
| 5,156,114 | | 10/1992 | Gunnerman | 44/301 X |
| 5,348,982 | * | 9/1994 | Herbolzheimer et al. | 518/700 |
| 5,545,674 | * | 8/1996 | Behrmann et al. | 518/715 |

FOREIGN PATENT DOCUMENTS

| | | | |
|---|---|---|---|
| 0209758A | 1/1987 | (EP) | C10L/1/32 |
| 0363300A | 4/1990 | (EP) . | |
| WO9708276 | 3/1997 | (WO) | C10L/1/32 |

* cited by examiner

*Primary Examiner*—Richard D. Lovering
(74) *Attorney, Agent, or Firm*—Jay Simon

(57) ABSTRACT

Fischer-Tropsch liquids, useful as distillate fuels are emulsified with water and a non-ionic surfactant.

10 Claims, No Drawings

WATER EMULSIONS OF FISCHER-TROPSCH LIQUIDS (LAW516)

This is a continuation of application Ser. No. 08/928,236, filed Sep. 12, 1997, now abandoned.

FIELD OF THE INVENTION

This invention relates to stable, macro emulsions comprising Fischer-Tropsch liquids and water.

BACKGROUND OF THE INVENTION

Hydrocarbon-water emulsions are well known and have a variety of uses, e.g., as hydrocarbon transport mechanisms, such as through pipelines, or as fuels, e.g., for power plants or internal combustion engines. These emulsions are generally described as macro emulsions, that is, the emulsion is cloudy or opaque as compared to micro emulsions that are clear, translucent, and thermodynamically stable because of the higher level of surfactant used in preparing micro-emulsions.

While aqueous fuel emulsions are known to reduce pollutants when burned as fuels, the methods for making these emulsions and the materials used in preparing the emulsions, such as surfactants and co-solvents, e.g., alcohols, can be expensive. Further, the stability of known emulsions is usually rather weak, particularly when low levels of surfactants are used in preparing the emulsions.

Consequently, there is a need for stable macro emulsions that use less surfactants or co-solvents, or less costly materials in the preparation of the emulsions. For purposes of this invention, stability of macro emulsions is generally defined as the degree of separation occurring during a twenty-four hour period, usually the first twenty-four hour period after forming the emulsion.

SUMMARY OF THE INVENTION

In accordance with this invention a stable, macro emulsion wherein water is the continuous phase is provided and comprises a Fischer-Tropsch derived hydrocarbon liquid, water and a surfactant. Preferably, the emulsion is prepared in the substantial absence, e.g., ≦2.0 wt % and preferably less than 1.0 wt %, or absence of the addition of a co-solvent, e.g., alcohols, and preferably in the substantial absence of co-solvent, that is, Fischer-Tropsch liquids may contain trace amounts of oxygenates, including alcohols; these oxygenates make up less oxygenates than would be present if a co-solvent was included in the emulsion. Generally, the alcohol content of the Fischer-Tropsch derived liquids is nil in the sense of not being measurable, and is generally less than about 2 wt % based on the liquids, more preferably less than about 1 wt % based on the liquids.

The macro-emulsions that are subject of this invention are generally easier to prepare and more stable than the corresponding emulsion with petroleum derived hydrocarbons. For instance, at a given surfactant concentration the degree of separation of the emulsions is significantly lower than the degree of separation of emulsions containing petroleum derived hydrocarbons. Furthermore, the emulsions require less surfactant than required for emulsions of petroleum derived hydrocarbon liquids, and does not require the use of co-solvents, such as alcohols, even though small amounts of alcohols may be present in the emulsions by virtue of the use of Fischer-Tropsch process water.

PREFERRED EMBODIMENTS

The Fischer-Tropsch derived liquids used in this invention are those hydrocarbons containing materials that are liquid at room temperature. Thus, these materials may be the raw liquids from the Fischer-Tropsch hydrocarbon synthesis reactor, such as $C_4$+ liquids, preferably $C_5$+ liquids, more preferably $C_5$–$C_{17}$ hydrocarbon containing liquids, or hydroisomerized Fischer-Tropsch liquids such as $C_5$+liquids. These materials generally contain at least about 90% paraffins, normal or iso-paraffins, preferably at least about 95% paraffins, and more preferably at least about 98% paraffins.

These liquids may be further characterized as fuels: for example, naphthas, e.g., boiling in the range $C_4$ to about 320° F., preferably $C_5$–320° F., water emulsions of which may be used as power plant fuels; transportation fuels, jet fuels, e.g., boiling in the range of about 250–575° F., preferably 300 to 550° F., and diesel fuels, e.g., boiling in the range of about 320 to 700° F. Other liquids derived from Fischer-Tropsch materials and having higher boiling points are also included in the materials useful in this invention.

Generally, the emulsions contain 10 to 90 wt % Fischer-Tropsch derived hydrocarbon liquids, preferably 30 to 80 wt %, more preferably 50 to 70 wt % Fischer-Tropsch derived liquids. Any water may be used; however, the water obtained from the Fischer-Tropsch process is particularly preferred.

Fischer-Tropsch derived materials usually contain few unsaturates, e.g., ≦1 wt %, olefms & aromatics, preferably less than about 0.5 wt % total aromatics, and nil-sulfur and nitrogen, i.e., less than about 50 ppm by weight sulfur or nitrogen. Hydrotreated Fischer-Tropsch liquids may also be used which contain virtually zero or only trace amounts of oxygenates, olefins, aromatics, sulfur, and nitrogen.

The non-ionic surfactant is usually employed in relatively low concentrations vis-a-vis petroleum derived liquid emulsions. Thus, the surfactant concentration is sufficient to allow the formation of the macro, relatively stable emulsion. Preferably, the amount of surfactant employed is at least about 0.001 wt % of the total emulsion, more preferably about 0.001 to about 3 wt %, and most preferably 0.01 to less than 2 wt %.

Typically, surfactants useful in preparing the emulsions of this invention are non-ionic and are those used in preparing emulsions of petroleum derived or bitumen derived materials, and are well known to those skilled in the art. These surfactants usually have a HLB of about 7–25, preferably 9–15. Useful surfactants for this invention include alkyl ethoxylates, linear alcohol ethoxylates, and alkyl glucosides, preferably ethoxylated alkyl phenols, and more preferably ethoxylated alkyl, e.g., nonyl, phenols with about 8–15 ethylene oxide units per molecule. A preferred emulsifier is an alkyl phenoxy polyalcohol, e.g., nonyl phenoxy poly (ethyleneoxy ethanol), commercially available under the trade name Igepol.

The use of water-fuel emulsions significantly improves emission characteristics of the fuels and particularly so in respect of the materials of this emission invention where Fischer-Tropsch water emulsions have better emission characteristics than petroleum derived emulsions, i.e., in regard to particulate emissions.

The emulsions of this invention are formed by conventional emulsion technology, that is, subjecting a mixture of the hydrocarbon, water and surfactant to sufficient shearing, as in a commercial blender or its equivalent for a period of time sufficiently forming the emulsion, e.g., generally a few seconds. For emulsion formative, see generally, "Colloidal Systems and Interfaces", S. Ross and I. D. Morrison, J. W. Wiley, NY, 1988.

The Fischer-Tropsch process is well known in these skilled in the art, see for example, U.S. Pat. Nos. 5,348,982 and 5,545,674 incorporated herein by reference and typically involves the reaction of hydrogen and carbon monoxide in a molar ratio of about 0.5/1 to 4/1, preferably 1.5/1 to 2.5/1, at temperatures of about 175–400° C., preferably about 180°–240°, at pressures of 1–100 bar, preferably about 10–40 bar, in the presence of a Fischer-Tropsch catalyst, generally a supported or unsupported Group VIII, non-noble metal, e.g., Fe, Ni, Ru, Co and with or without a promoter, e.g. ruthenium, rhenium, hafnium, zirconium, titanium. Supports, when used, can be refractory metal oxides such as Group IVB, i.e., titania, zirconia, or silica, alumina, or silica-alumina. A preferred catalyst comprises a non-shifting catalyst, e.g., cobalt or ruthenium, preferably cobalt, with rhenium or zirconium as a promoter, preferably cobalt and rhenium supported on silica or titania, preferably titania. The Fischer-Tropsch liquids, i.e., $C_5$+, preferably $C_{10}$+, are recovered and light gases, e.g., unreacted hydrogen and CO, $C_1$ to $C_3$ or $C_4$ and water are separated from the hydrocarbons.

The non-shifting Fischer-Tropsch process, also known as hydrocarbon synthesis may be shown by the reaction:

$$2nH_2+nCO \rightarrow CnH_{2n+2}+nH_2O$$

A preferred source of water for preparing the emulsions of this invention is the process water produced in the Fischer-Tropsch process, preferably a non-shifting process. A generic composition of this water is shown below, and in which oxygenates are preferably ≦2.0 wt %, more preferably less than 1 wt % oxygenates.

| | |
|---|---|
| $C_1$–$C_{12}$ alcohols | 0.05–2 wt %, preferably 0.05–1.2 wt % |
| $C_2$–$C_6$ acids | 0–50 ppm |
| $C_2$–$C_6$ ketones, aldehydes, acetates | 0–50 ppm |
| other oxygenates | 0–500 ppm |

Hydroisomerization conditions for Fischer-Tropsch derived hydrocarbons are well known to those skilled in the art. Generally, the conditions include:

| CONDITION | BROAD | PREFERRED |
|---|---|---|
| Temperature, ° F. | 300–900 (149–482° C.) | 550–750 (288–399° C.) |
| Total pressure, psig | 300–2500 | 300–1500 |
| Hydrogen Treat Rate, SCF/B | 500–5000 | 2000–4000 |

Catalysts useful in hydroisomerization are typically bifunctional in nature containing an acid function as well as a hydrogenation component. A hydrocracking suppressant may also be added. The hydrocracking suppressant may be either a Group 1B metal, e.g., preferably copper, in amounts of about 0.1–10 wt %, or a source of sulfur, or both. The source of sulfur can be provided by presulfiding the catalyst by known methods, for example, by treatment with hydrogen sulfide until breakthrough occurs.

The hydrogenation component may be a Group VIII metal, either noble or non-noble metal. The preferred non-noble metals include nickel, cobalt, or iron, preferably nickel or cobalt, more preferably cobalt. The Group VIII metal is usually present in catalytically effective amounts, that is, ranging from 0.1 to 20 wt %. Preferably, a Group VI metal is incorporated into the catalyst, e.g., molybdenum, in amounts of about 1–20 wt %.

The acid functionality can be furnished by a support with which the catalytic metal or metals can be composite in well known methods. The support can be any refractory oxide or mixture of refractory oxides or zeolites or mixtures thereof. Preferred supports include silica, alumina, silica-alumina, silica-alumina-phosphates, titania, zirconia, vanadia and other Group III, IV, V or VI oxides, as well as Y sieves, such as ultra stable Y sieves. Preferred supports include alumina and silica-alumina, more preferably silica-alumina where the silica concentration of the bulk support is less than about 50 wt %, preferably less than about 35 wt %, more preferably 15–30 wt %. When alumina is used as the support, small amounts of chlorine or fluorine may be incorporated into the support to provide the acid functionality.

A preferred support catalyst has surface areas in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis; Volume VII, Ed. Paul H. Emmett, Reinhold Publishing Corporation, New York, 1960.

During hydroisomerization, the 700° F.+ conversion to 700° F.– ranges from about 20–80%, preferably 30–70%, more preferably about 40–60%; and essentially all olefins and oxygenated products are hydrogenated.

The catalyst can be prepared by any well known method, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen containing gas, and, if desired, sulfiding by treatment with a sulfur containing gas, e.g., $H_2S$ at elevated temperatures. The catalyst will then have about 0.01 to 10 wt % sulfur. The metals can be composited or added to the catalyst either serially, in any order, or by co-impregnation of two or more metals.

The following examples will serve to illustrate but not limit this invention.

EXAMPLE 1

A mixture of hydrogen and carbon monoxide synthesis gas ($H_2$:CO 2.11–2.16) was converted to heavy paraffins in a slurry Fischer-Tropsch reactor. A titania supported cobalt/rhenium catalyst was utilized for the Fischer-Tropsch reaction. The reaction was conducted at 422–428° F., 287–289 psig, and the feed was introduced at a linear velocity of 12 to 17.5 cm/sec. The hydrocarbon Fischer-Tropsch product was isolated in three nominally different boiling streams; separated by utilizing a rough flash. The three boiling fractions which were obtained were: 1) $C_5$ to about 500° F., i.e., F-T cold separator liquid; 2) about 500 to about 700° F., i.e., F-T hot separator liquid; and 3) a 700° F. + boiling fraction, i.e., a F-T reactor wax. The Fischer-Tropsch process water was isolated from the cold separator liquid and used without further purification.

The detailed composition of this water is listed in Table 1.Table 2 shows the composition of the cold separator liquid.

TABLE 1

Composition of Fischer-Tropsch Process Water

| Compound | wt % | ppm O |
|---|---|---|
| Methanol | 0.70 | 3473.2 |
| Ethanol | 0.35 | 1201.7 |
| 1-Propanol | 0.06 | 151.6 |
| 1-Butanol | 0.04 | 86.7 |
| 1-Pentanol | 0.03 | 57.7 |
| 1-Hexanol | 0.02 | 27.2 |
| 1-Heptanol | 0.005 | 7.4 |
| 1-Octanol | 0.001 | 1.6 |
| 1-Nonanol | 0.0 | 0.3 |
| Total Alcohols | 1.20 | 5007.3 |
| **Acid** | **wppm** | **wppm O** |
| Acetic Acid | 0.0 | 0.0 |
| Propanoic Acid | 1.5 | 0.3 |
| Butanoic Acid | 0.9 | 0.2 |
| Total Acids | 2.5 | 0.5 |
| Acetone | 17.5 | 4.8 |
| Total Oxygen | | 5012.6 |

TABLE 2

Composition of Fischer-Tropsch Cold Separator Liquid

| Carbon # | Paraffins | Alcohol | ppm O |
|---|---|---|---|
| C5 | 1.51 | 0.05 | 90 |
| C6 | 4.98 | 0.20 | 307 |
| C7 | 8.46 | 0.20 | 274 |
| C8 | 11.75 | 0.17 | 208 |
| C9 | 13.01 | 0.58 | 640 |
| C10 | 13.08 | 0.44 | 443 |
| C11 | 11.88 | 0.18 | 169 |
| C12 | 10.36 | 0.09 | 81 |
| C13 | 8.33 | | |
| C14 | 5.91 | | |
| C15 | 3.76 | | |
| C16 | 2.21 | | |
| C17 | 1.24 | | |
| C18 | 0.69 | | |
| C19 | 0.39 | | |
| C20 | 0.23 | | |
| C21 | 0.14 | | |
| C22 | 0.09 | | |
| C23 | 0.06 | | |
| C24 | 0.04 | | |
| TOTAL | 98.10 | 1.90 | 2211 |

EXAMPLE 2

A 70% oil-in-water emulsion was prepared by pouring 70 ml of cold separator liquid from example 1 onto 30 ml of an aqueous phase containing distilled water and a surfactant. Two surfactants belonging to the ethoxylated nonyl phenols with 15 and 20 moles of ethylene oxide were used. The surfactant concentration in the total oil-water mixture varied from 1500 ppm to 6000 ppm. The mixture was blended in a Waring blender for one minute at 3000 rpm.

The emulsions were transferred to graduated centrifuge tubes for studying the degree of emulsification ("complete" versus "partial") and the shelf stability of the emulsion. "Complete" emulsification means that the entire hydrocarbon phase is dispersed in the water phase resulting in a single layer of oil-in-water emulsion. "Partial" emulsification means that not all the hydrocarbon phase is dispersed in the water phase. Instead, the oil-water mixture separates into three layers: oil at the top, oil-in-water-emulsion in the middle, and water at the bottom. The shelf stability (SS) is defined as the volume percent of the aqueous phase still retained by the emulsion after 24 hours. Another measure of stability, emulsion stability (ES) is the volume percent of the total oil-water mixture occupied by the oil-in-water emulsion after 24 hours. The oil droplet size in the emulsion was measured by a laser particle size analyzer.

As shown in Table 3, surfactant A with 15 moles of ethylene oxide (EO) provided complete emulsification of the paraffinic oil in water at concentrations of 3000 ppm and 6000 ppm. Only "partial" emulsification was possible at a surfactant concentration of 1500 ppm. Surfactant B with 20 moles of EO provided complete emulsification at a concentration of 6000 ppm. Only partial emulsification was possible with this surfactant at a concentration of 3000 ppm. Thus, surfactant A is more effective than surfactant B for creating the emulsion fuel.

The emulsions prepared with surfactant A were more stable than those prepared with surfactant B. The SS and ES stability of the emulsion prepared with 3000 ppm of surfactant A are similar to those of the emulsion prepared with 6000 ppm of surfactant B. After seven days of storage, the complete emulsions prepared with either surfactant released some free water but did not release any free oil. The released water could easily be remixed with the emulsion on gentle mixing. As shown in Table 3, the mean oil droplet size in the emulsion was 8 to 9 $\mu$m.

TABLE 3

Properties of 70:30 (oil:water) emulsion prepared with Distilled Water and Fischer-Tropsch Cold Separator Liquid

| Surfactant Type | Surfactant conc., ppm | Degree of emulsification | Stability SS* (%) | Stability ES* (%) | Mean Diameter, $\mu$ |
|---|---|---|---|---|---|
| A (15EO) | 1500 | Partial | 16 | 24 | — |
| A (15EO) | 3000 | Complete | 89 | 96 | 9.3 |
| A (15EO) | 6000 | Complete | 94 | 98 | 8.2 |
| B (20EO) | 3000 | Partial | 16 | 24 | — |
| B (20EO) | 6000 | Complete | 91 | 97 | 8.6 |

EXAMPLE 3

The conditions for preparing the emulsions in this example are the same as those in Example 2 except that Fischer-Tropsch (F-T) process water from Example 1 was used in place of distilled water.

The emulsion characteristics from this example are shown in Table 4. A comparison with Table 3 reveals the advantages of process water over distilled water. For example, with distilled water, only partial emulsification was possible at a surfactant B concentration of 3000 ppm. Complete emulsification, however, was achieved with Fischer-Tropsch water at the same concentration of the surfactant.

The SS and ES stability of the emulsions prepared with process water are higher than those prepared with distilled water in all the tests. For the same stability, the emulsion prepared with process water requires 3000 ppm of surfactant A, while the emulsion prepared with distilled water needs 6000 ppm of the same surfactant. Evidently, the synergy of the process water chemicals with the external surfactant results in a reduction of the surfactant concentration to obtain an emulsion of desired stability.

The SS and ES stability relates to emulsion quality after 24 hours of storage. Table 5 includes the too stability data for emulsions prepared with distilled and F-T process water that go beyond 24 hours. The $t_{10}$ stability is defined as the time required to lose 10% of the water from the emulsions. With surfactant A at 3000 ppm, the $t_{10}$ stability for emulsions prepared with distilled water is 21 hours, while the too stability for emulsions prepared with process water is 33 hours.

Thus, these examples clearly show the benefit of preparing emulsions with F-T process water, which is a product of the Fischer-Tropsch process.

TABLE 4

Properties of 70:30 (oil:water) emulsion prepared with Fischer-Tropsch "Process" Water Using Fischer-Tropsch Cold Separator Liquid

| Surfactant Type | Surfactant conc., ppm | Degree of emulsification | Stability SS* (%) | Stability ES* (%) | Mean Diameter, $\mu$ |
|---|---|---|---|---|---|
| A (15EO) | 1500 | Partial | 20 | 35 | — |
| A (15EO) | 3000 | Complete | 94 | 98 | 7.8 |
| A (15EO) | 6000 | Complete | 97 | 99 | 6.6 |
| B (20EO) | 3000 | Complete | 30 | 78 | 15.6 |
| B (20EO) | 6000 | Complete | 95 | 98 | 7.6 |

TABLE 5

Comparison of F-T Process and Distilled Water in Relation to Emulsion Quality for Fischer-Tropsch Cold Separator Liquid $t_{10}$* (hrs)

| Surfactant Type | Surfactant conc., ppm | Distilled Water | Process Water |
|---|---|---|---|
| A (15EO) | 1500 | 0.3 | 0.3 |
| A (15EO) | 3000 | 20.8 | 32.7 |
| A (15EO) | 6000 | 31.6 | 44.1 |
| B (20EO) | 3000 | 0.0 | 1.5 |
| B (20EO) | 6000 | 25.6 | 34.7 |

*SS is the percent of the original aqueous phase which remains in the emulsion after 24 hours.
*ES is the percent of the mixture which remains an emulsion after 24 hours.
*$t_{10}$ is the time required for a 10% loss of the aqueous phase from the emulsion.

EXAMPLE 4

A wide variety of HLB values for the non-ionic surfactant may be used; i.e. for an ethoxylated nonyl phenol a large range of ethylene oxide units. For the fuel shown in Example 1, a group of ethoxylated nonyl phenols were used, and the minimum surfactant concentration for a stable emulsion was determined. In all cases 70% oil: 30% tap water was used.

TABLE 6

| Ethylene Oxide units | HLB | Min. Surfactant | Storage Stability |
|---|---|---|---|
| 5 | 10 | 1% | 100% |
| 9 | 13 | 0.15% | 97% |
| 12 | 14.2 | 0.10% | 87% |
| 15 | 15 | 0.30% | 92% |
| 20 | 16 | 0.60% | 78% |

EXAMPLE 5

A large number of oil:water ratios can be employed in this invention. The ratio of oil to water described in Example 4 were varied while determining the optimum surfactant and minimum surfactant concentration to form a stable emulsion. The surfactants employed were ethoxylated nonyl ing HLB.

TABLE 7

| Oil:Water | Surfactant HLB | Surfactant Concentration | Storage Stability |
|---|---|---|---|
| 10:90 | 15.0 | 0.5% | 97% |
| 20:80 | 15 | 0.1% | 82% |
| 30:70 | 14.2 | 0.03% | 84% |
| 50:50 | 14.2 | 0.44% | 70% |
| 90:10 | 10.0 | 1.0% | 100% |

EXAMPLE 6

A variety of Fischer-Tropsch materials can be used in addition to the cold separator liquid employed in examples 1–5 above. All can be used at a variety of surfactant HLB, and oil:water ratios. This is shown in the following Table of examples for two other Fischer-Tropsch Liquids:

A: Fischer-Tropsch naphtha, the nominal $C_5$–320° F. cut from the output of the hydroisomerization of Fischer-Tropsch wax.

B: Fischer-Tropsch diesel, the nominal 320–700° F. cut from the output of the hydroisomerization of Fischer-Tropsch wax. Water used in the emulsions were either:

C: Tap Water

D: Fischer-Tropsch process water described in Example 1 above.

In both cases Fuels A and B contain nil sulfur, aromatics, nitrogen, olefins, and oxygenates and no co-solvents were used.

TABLE 8

| Oil:Water | Surfactant HLB | Surfactant Conc. | Storage Stability | Fuel | Water |
|---|---|---|---|---|---|
| 50:50 | 11.0 | 0.03% | 76% | A | D |
| 70:30 | 10.0 | 0.10% | 71% | A | D |
| 70:30 | 15.0 | 0.10% | 90% | A | C |
| 70:30 | 14.2 | 0.30% | 95% | A | C |
| 70:30 | 11.0 | 0.30% | 95% | A | C |
| 70:30 | 15.0 | 0.22% | 80% | B | D |

We claim:

1. A hydrocarbon in water emulsion comprising 10–90 wt % of $C_5$+ liquid hydrocarbon, water, and a non-ionic surfactant, the liquid hydrocarbon consisting essentially of a Fischer-Tropsch derived hydrocarbon.

2. The emulsion of claim 1 wherein the hydrocarbon is derived from a non-shifting Fischer-Tropsch process.

3. The emulsion of claim 1 wherein the hydrocarbon is selected from the group consisting of $C_4$–320° F. naphtha, and transportation fuels boiling in the range 320–700° F.

4. The emulsion of claim 3 wherein the water is derived from a non-shifting Fischer-Tropsch process.

5. The emulsion of claim 4 in which there is a substantial absence of added co-solvent.

6. The emulsion of claim 3 wherein the surfactant has an HLB of 7–25.

7. The emulsion of claim 6 wherein the surfactant is present in an amount of 0.01 to 2 vol %.

8. The emulsion of claim 1 wherein the surfactant is an ethoxylated alkyl phenol having from 8 to 15 ethylene oxide units per molecule.

9. A process for emulsifying Fischer-Tropsch derived liquids comprising reacting hydrogen and carbon monoxide in the presence of a Fischer-Tropsch catalyst at reaction conditions, recovering hydrocarbon containing liquids from the reaction, recovering water produced in the reactor, and emulsifying the liquids with the water and a non-ionic surfactant.

10. The process of claim 9 wherein the hydrocarbons containing liquids are hydroisomerized prior to being emulsified.

* * * * *